US005389105A

United States Patent [19]

Mann

[11] Patent Number: 5,389,105

[45] Date of Patent: * Feb. 14, 1995

[54] EAR PIERCING APARATUS WITH ROTATABLY DISPLACEABLE PUSH ROD

[75] Inventor: Samuel J. Mann, Englewood, N.J.

[73] Assignee: Inverness Corporation, Fair Lawn, N.J.

[ * ] Notice: The portion of the term of this patent subsequent to Nov. 23, 2010 has been disclaimed.

[21] Appl. No.: 142,998

[22] Filed: Oct. 26, 1993

[51] Int. Cl.[6] ..... A61B 17/34

[52] U.S. Cl. ..... 606/188

[58] Field of Search ..... 606/184, 185, 186, 188; 24/27, 37

[56] References Cited

U.S. PATENT DOCUMENTS 4,931,060 6/1990 Aué ..... 606/188

5,263,960 11/1993 Mann ..... 606/188

FOREIGN PATENT DOCUMENTS 0293553 12/1988 European Pat. Off. ..... 606/188

2142538 1/1985 United Kingdom ..... 606/188

*Primary Examiner*—Stephen C. Pellegrino

*Assistant Examiner*—William W. Lewis

*Attorney, Agent, or Firm*—Stroock & Stroock & Lavan

[57] ABSTRACT

An ear piercing assembly includes a housing. First and second ear piercing earrings are releasably supported within the housing. A plunger assembly is disposed within said housing and selectively ejects an ear piercing earring from the housing. The plunger assembly is movable between a first position for ejecting the first ear piercing earring and a second position for ejecting the second ear piercing earring.

16 Claims, 6 Drawing Sheets

EAR PIERCING APARATUS WITH ROTATABLY DISPLACEABLE PUSH ROD

BACKGROUND OF THE INVENTION

This invention is directed to an ear piercing assembly, and in particular, to a disposable ear piercing instrument having a displaceable plunger.

Ear piercing systems are well-known in the art. For improved sterility and safety and to prevent cross contamination, disposable ear piercing instruments have been developed to minimize handling of clutches, ear piercing earrings, and ear piercing assemblies; removing sources of cross-contamination. A first disposable ear piercing apparatus utilizes a disposable cartridge containing the ear piercing earring and clutch. The stud and clutch are stored in the cartridge which may be removed from the ear piercing assembly for disposal after ear piercing. Such an ear piercing assembly is known from applicant's co-pending U.S patent application Ser. No. 07/975,318. A second disposable ear piercing instrument is manufactured with the ear piercing stud and clutch already provided within the ear piercing instrument itself so that after a use, the entire ear piercing assembly is disposed. This apparatus is known from applicant's co-pending U.S. patent application Ser. No. 07/936,936. In this apparatus the studs are contained within a housing mounted within the apparatus and a single push rod is moved behind the respective stud to eject the desired stud.

Both of these prior art devices are satisfactory. However, both ear piercing assemblies require some form of cartridge assembly for housing the piercing stud or earring and the clutch resulting in a complex construction. Additionally, the device utilizing the disposable clutch cartridge makes use of a dual plunger assembly requiring complex alignment and a complex plunger structure. The entirely disposable ear piercing instrument is only capable of using ear piercing studs and therefore suffers from the additional disadvantage that ornamental earrings cannot be used as the ear piercing earring in the piercing process. Accordingly, a disposable ear piercing instrument which simplifies the construction while allowing the use of ear piercing earrings, overcoming the shortcomings of the prior art is desired.

SUMMARY OF THE INVENTION

Generally speaking, in accordance with the instant invention, a disposable ear piercing assembly is provided. A housing is formed with an anvil thereon to define a saddle region for receiving an earlobe between the anvil and the remainder of the housing. Two clutches in side by side relationship are secured within the anvil. A first capsule and a second capsule containing a respective ear piercing earring therein are mounted within the housing for cooperating with an associated clutch. A plunger assembly is rotatably mounted within the housing and is selectively capable of driving either the first or second capsule so as to permit the ear piercing earring contained therein to engage the associated clutch.

In one embodiment of the invention, each capsule is slottably retained within the housing so that the capsule is moved towards the clutch prior to ejection of the ear piercing earring from the capsule. The plunger assembly is formed with a dog legged push rod which drives the respective capsule. The push rod is dimensioned to form a friction fit with a capsule to return the capsule to a starting position. The housing is also formed with an indicating structure for indicating which earring within the housing is to be ejected for piercing.

Accordingly, it is an object of the present invention to provide an improved ear piercing instrument.

Another object of the instant invention is to provide a disposable ear piercing instrument wherein at least two ear piercing earrings and two clutches are positioned within the instrument and require no handling of the earring or clutches to perform ear piercing.

A further object of the invention is to provide a safe and disposable ear piercing instrument having a simple and inexpensive construction.

Yet another object of the present invention is to provide an improved ear piercing instrument which reduces the amount of handling of the ear piercing earrings, clutch and/or instrument.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
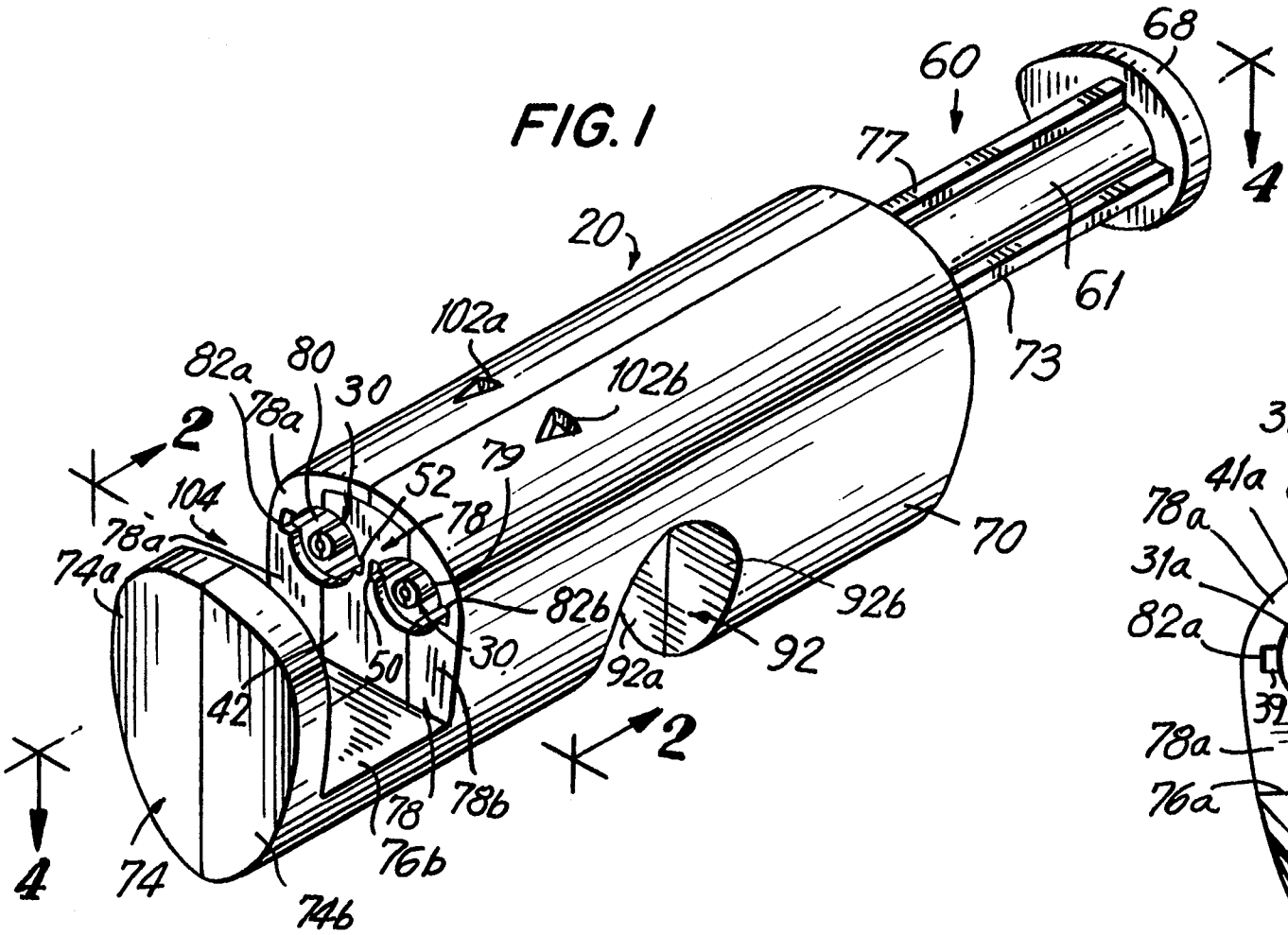
FIG. 1 is a perspective view of the ear piercing apparatus constructed in accordance with the invention.
Figure 2:
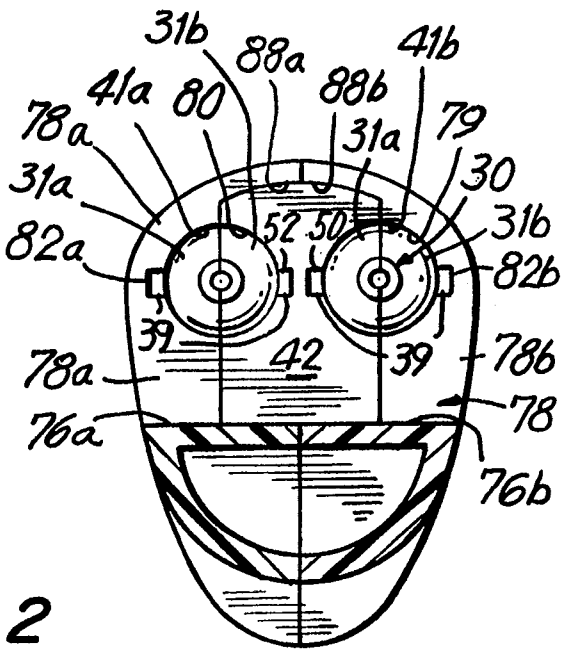
FIG. 2 is a sectional view taken along line 2—2 of FIG. 1.

Reference is now had to FIGS. 1, 3, 5 and 7 wherein an ear piercing assembly, constructed in accordance with a preferred embodiment of the instant invention, and generally indicated as 20, is depicted. Ear piercing assembly 20 includes ear piercing earring retaining capsule cartridges ("capsules") 30, a centerpiece 40, and a dog leg plunger assembly generally indicated as 60.

Plunger assembly 60, capsule cartridges 30 and centerpiece 40 are all supported within a housing 70.

Housing 70 is formed of two halves 72*a*, 72*b* of a substantially hollow molded casing. Except where denoted, halves 72*a*, 72*b* are mirror images of each other so that for simplicity of description housing halve 72*a* will be described with numerals denoted with "a" and the description is equally applicable to the structures denoted by the same numeral with the indication of "b" of housing 72*b*.

Housing halve 72*a* includes an anvil 74*a*. A front wall 78*a* is formed on housing halve 72*a* and is separated from anvil 74*a* by floor 76*a*. A half channel 80*a* is formed between a back wall 86*a* and front wall 78*a*. A semicircular groove 86*a* is formed in back wall 84*a* of half channel 80*a*. Groove 82*a* is formed along channel 80*a* to provide a track therein. Groove 82*a* is substantially parallel to groove 82*b* formed in a channel 80*b* of housing halve 72*b*. A stepped portion 88*a* is formed in housing halve 72*a* adjacent channel 80*a*. A slot 90*a* substantially co-extensive with channel 80*a* is formed in housing halve 72*a*.

A tunnel 92*a* is formed in housing halve 72*a*. Housing halve 72*a* includes a back wall 94*a* having a semicircular groove 96*a* formed therein. A step 98*a* is formed at the top and bottom of semicircular groove 95*a* and a squared slot 100*a* is formed along semicircular groove 96*a*.

Halves 72*a*, 72*b* are joined together. A dowel 85 formed on anvil 74*b* is received by an opening 83 on anvil 74*a*. Additionally, spacers 81 formed on halve 72*a* may receive screws 28 or may be glued together to maintain the housing in a closed position to form housing 70. When halves 72*a* and 72*b* are formed together, floor 76*a*, 76*b* form a saddle region 104 between an anvil 74 formed from anvils 74*a*, 74*b* and a front wall 78 formed by front wall halves 78*a*, 78*b* and centerpiece 40. Additionally, tunnels 92*a*, 92*b* form a finger anchor 92. Semicircular grooves 96*a*, 96*b* form an opening 96 in a rear wall 94 formed by rear walls 94*a*, 94*b* of housing 70. Additionally, stepped portions 98*a*, 98*b* form slots 98.

Centerpiece 40 is formed as a molded unitary construction having an X-shaped portion 41 which includes a front wall 42. A half channel 43 (FIG. 11) extends from front wall 42 to a rear wall 46 of centerpiece 40. A slot 52 extends along the length of half channel 43 forming a track. A semicircular cutout 45 is formed within front wall 42 at one end of half channel 43 and a second semicircular cutout 53 is formed in rear wall 46 at a second end of half channel 43. A slot 52 extends along the length of half channel 43.

A second half channel 44 (FIG. 3) is formed within X-shaped portion 41 and extends from front wall 42 to rear wall 46 of X-shaped portion 41. A semicircular cutout 47 is formed in front wall 42 at one end of half channel 44 and a semicircular cutout 48 is formed in rear wall 46 at the other end of half channel 44. A slot 50 extends along the length of half channel 44. Half channel 44 is in a substantially back to back relationship with half channel 43.

A first tab 56 extends along a first side of centerpiece 40 and a second tab 58 extends along the opposite side of centerpiece 40. A shaft 54 extends from rear wall 46 in a direction away from X-shaped portion 41 of centerpiece 40. An indicating ring 106 is rotatably mounted about shaft 54. Indicating ring 106 includes a notch 108 along its inner diameter. A portion of the circumference of indicating ring 106 is marked with an indicating color 110, such as red. Indicating ring 106 is disposed on shaft 54 so that indicating mark 110 may pass below either one of windows 102*a*, 102*b* as it is pivoted about shaft 54.

When assembled, centerpiece 40 is positioned between housing halves 72*a*, 72*b*. Tab 56 is received by slot 90*a* and tab 58 is received by slot 90*b* to maintain centerpiece 40 in position. When in position, front walls 78*a*, 42, 78*b* combine to form a single front wall 78 at one end of saddle region 104 (FIG. 1). Half channel 43 has the same dimensions as half channel 80*a* and the two are positioned to form in tandem a chamber 80. Wall 42 is received within stepped portions 88*a*, 88*b* of housing halves 72*a*, 72*b* to form a flush front wall 78. An opening 41*a* to chamber 80 is formed by semicircular cutout 45 cooperating with semicircular cutout 89*a*. Similarly, a second chamber 79 is formed by half channel 44 cooperating with half channel 80*b* having an opening 41*b* in front wall 78 formed by semicircular cutout 47 cooperating with semicircular cutout 89*b*. A rear wall to chambers 79, 80 is formed by rear walls 84*a*, 46, 84*b*. Semicircular cutout 86*a* cooperates with semicircular cutout 53 to form a rear opening 87 to channel 80. Similarly, semicircular cutout 86*b* cooperates with semicircular cutout 48 to provide a rear opening 89 to chamber 79. Chamber 79 includes slots 82*a* and 52. Additionally, X-shaped portion 41 is formed with stepped region 110, 112, 114, and 116 (FIG. 7) formed on a respective arm of X-shaped portion 41. X-shaped portions 110, 112 cooperate with housing halve 72*a* to form slots 118 and 120 in chamber 80. Similarly, stepped portions 114, 116 cooperate with housing halve 72*b* to form slots 122 and 124 within chamber 79.

Figure 3:
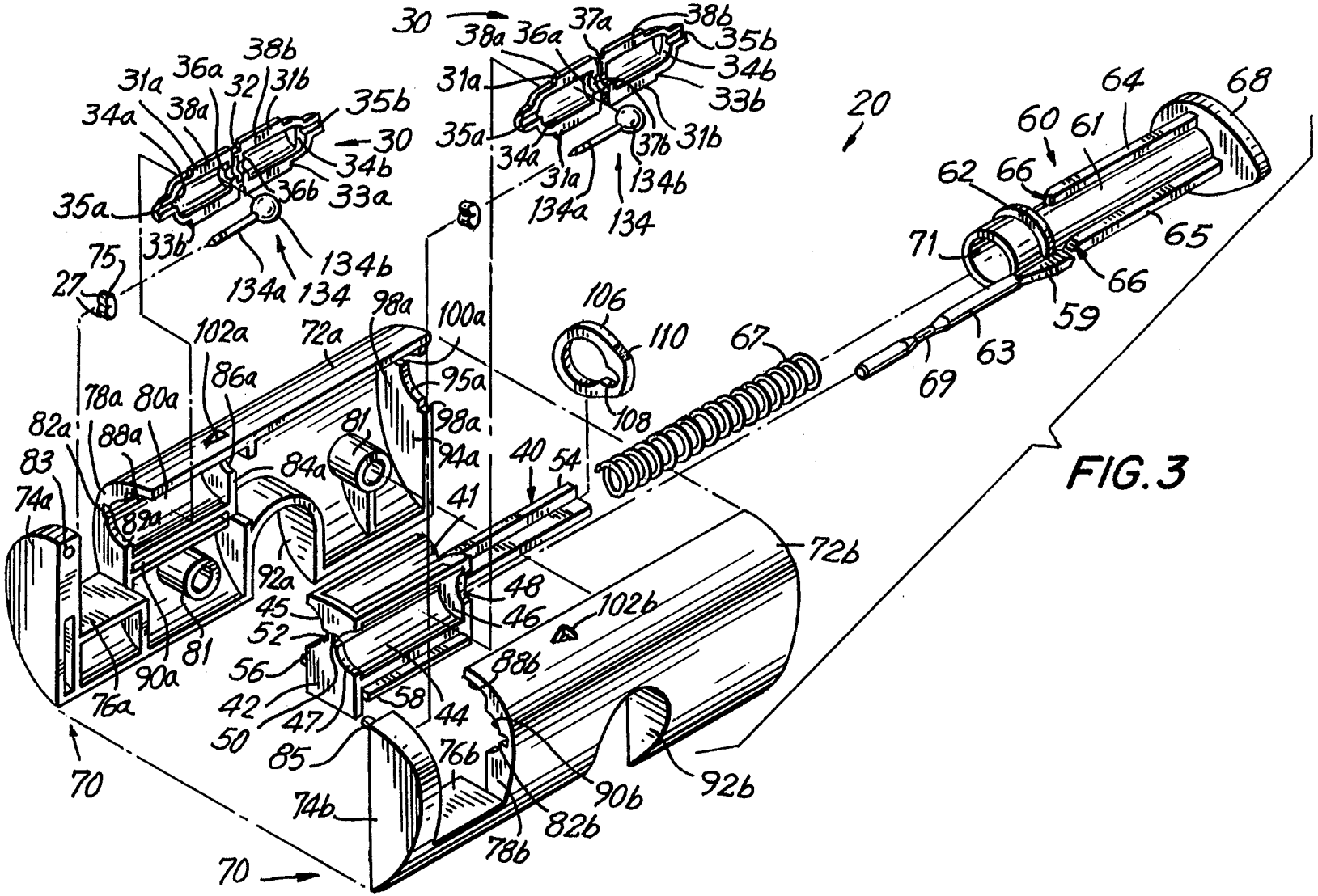
FIG. 3 is an exploded view of the ear piercing apparatus constructed in accordance with the invention.
Figure 4:
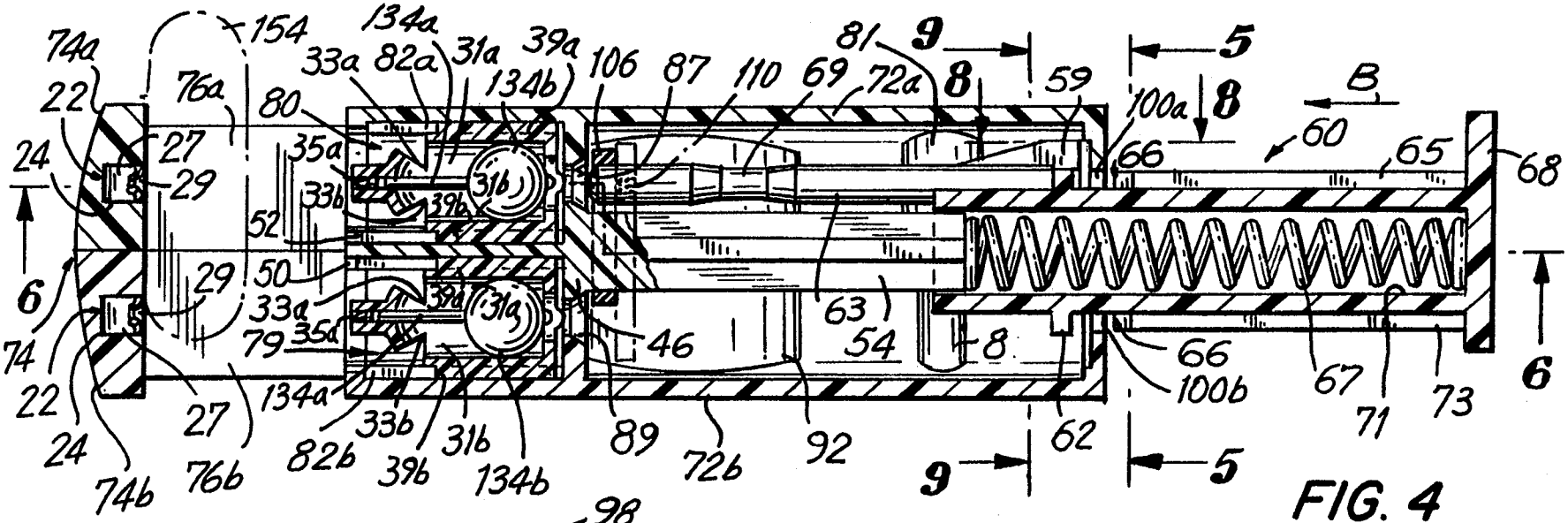
FIG. 4 is a sectional view taken along line 4—4 of FIG. 1.
Figure 5:
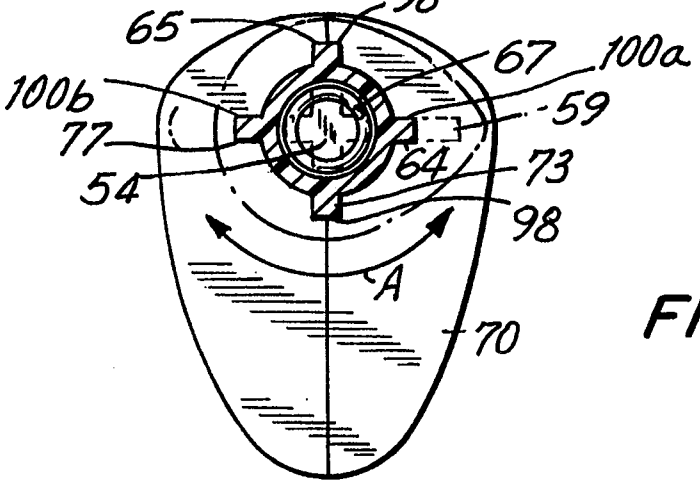
FIG. 5 is a sectional view taken along line 5—5 of FIG. 4.
Figures 6, 7:
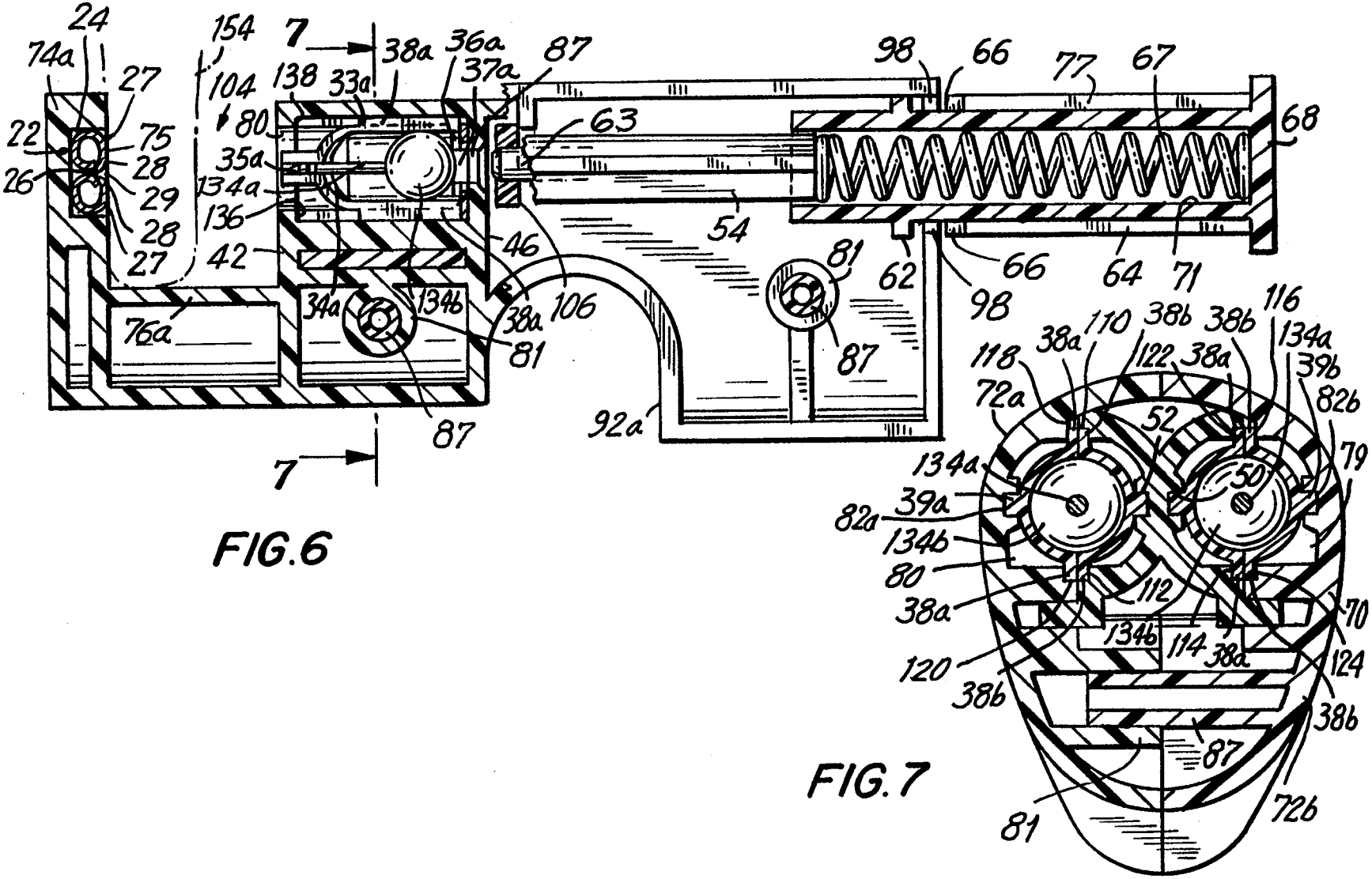
FIG. 6 is a sectional view taken along line 6—6 of FIG. 4.
FIG. 7 Is a sectional view taken along line 7—7 of FIG. 6.
Figure 8:
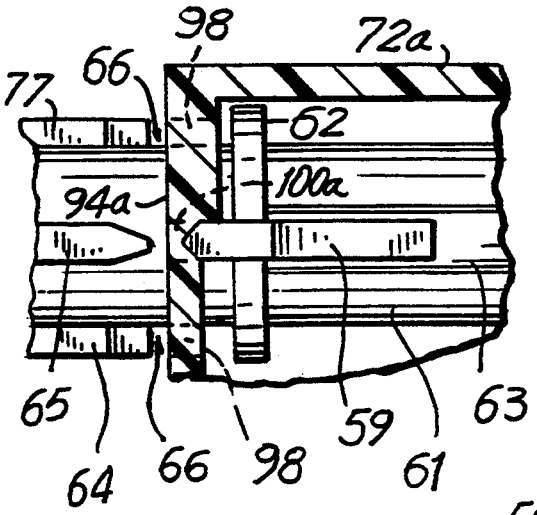
FIG. 8 is a sectional view taken along line 8—8 of FIG. 4.
Figure 9:
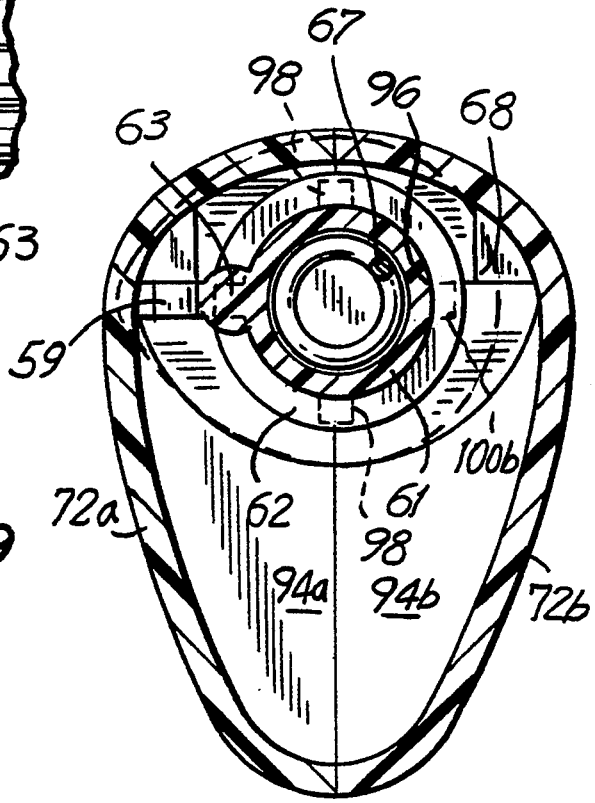
FIG. 9 is a sectional view taken along line 9—9 of FIG. 4.
Figure 10:
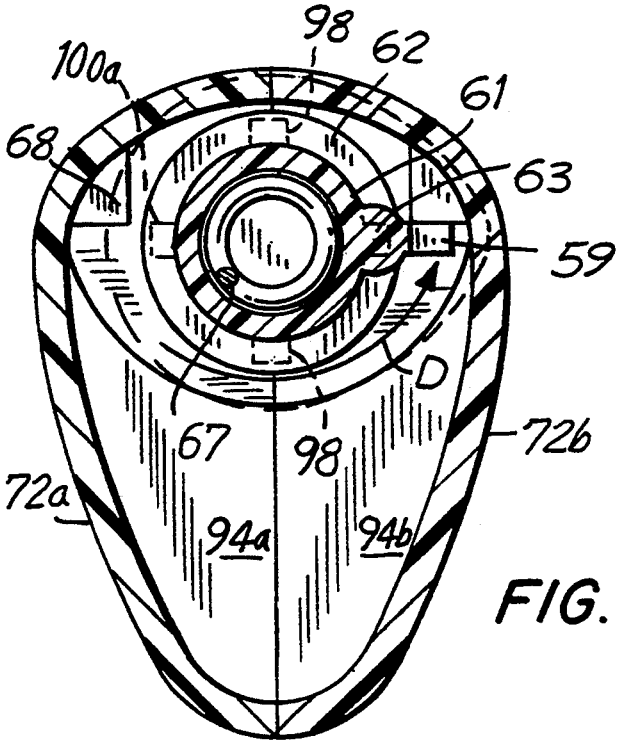
FIG. 10 is a sectional view taken along line 9—9 of FIG. 4, showing the plunger 180° rotated from that position shown in FIG. 9.

Reference is now made to FIGS. 3, 4 and 6 wherein a clutch retaining structure for retaining clutches 75 is depicted. Each clutch 75 is formed of a single piece of resilient metal having a C-shaped configuration forming two symmetrical loops 27, having ends 28. An opening 29 is provided in the metal for receiving a piercing pin 134*a* of an ear piercing earring 134 and is coaxial with the space between ends 28.

Each anvil 74*a*, 74*b* is formed as a solid molded piece. Again, anvil 74*a* will be described as representing both anvils 74*a* and 74*b*. Anvil 74*a* includes a clutch chamber 22 formed by a blind hole 24. Blind hole 24 is of sufficient depth to permit clutch 75 to be recessed from the outer surface of the casing defining anvil 74*a* so that clutch 75 is prevented from accidently coming into contact with a person's finger. A nib 26 projects from blind hole 24 and is extended to rest between the end 28 of loops 27 of each clutch 75 to place in position and secure clutch 75 in clutch chamber 22. When a piercing pin 134*a* of an ear piercing earring enters opening 29 and continues until it is between ends 28 of loops 27, the ends 28 are spread apart and are no longer held by nib 26. Accordingly, each clutch chamber 22 is configured to releaseably secure clutch 75 therein until clutch 75 is secured on piercing pin 134*a* of ear piercing earring 134 after an earlobe has been pierced. Clutch chambers 22 are positioned so that opening 29 of clutch 75 is substantially coaxially with a respective chamber 79, 80.

Reference is now made to FIGS. 3 and 4 wherein an earring capsule cartridge 30 formed of two half walls 31*a*, 31*b* connected by a hinge 32 is depicted. An exemplary embodiment of the half walls forming both cartridge 30 are molded of a low friction plastic to define a low friction inner surface. Half wall 31*a* is symmetrical with half wall 48b and accordingly the following description with respect to half wall 31a is identical with respect to half wall 31b and each element referred to herein with the lower case letter suffix (a) has a counter part with the same number and the suffix (b) unless otherwise specified. By way of orientation and to simplify the description of half wall 31a, the length thereof is defined herein as being along the axial direction defined by the movement of capsule cartridge 30 along chamber 80.

Half wall 31a includes flexible relief 33a, a spherical wall 34a, an elongated channel 35a, and a rear wall 36a. When half walls 31a and 31b are folded together, they, together with rear walls 36a, 36b define a cavity for receiving therein an ear piercing earring 134 having a piercing pin 134a and an earring head 134b.

Rear walls 36a, 36b are secured together by hinge 32. Indentations 37a, 37b are formed in rear walls 36a, 36b respectively, and define an opening 37 for receiving a dog legged push rod 63 during the ear piercing operation. A lateral projection 38a projects along half wall 31a at the rear of capsule cartridge 30. Another lateral projection 39a (FIG. 4) extends along half wall 31a.

During assembly of ear piercing assembly 20, piercing earring 134 is positioned in one of half walls 31a or 31b. Thereafter half walls 31a, 31b are folded along hinge 32 so that piercing earring 134 is disposed within capsule cartridge 30. Piercing pin 134a is positioned to define an interference fit in elongated channels 35a, 35b. Ear piercing earring head 134b rests against rear walls 36a, 36b.

A respective capsule cartridge 30 is maintained within each chamber 79, 80. Lateral projections 38a, 38b are slidably positioned within slots 122, 124 and lateral projections 39a, 39b are slidably positioned within slots 50, 82b of chamber 79 to orient capsule cartridge 30 within chamber 79. Similarly, lateral projections 38a, 38b are slidably disposed within slots 118, 120 and lateral projections 39a, 39b are slidably disposed within slots 52, 82a of chamber 80 to orient capsule cartridge 30 within chamber 80. As seen in FIG. 6, front wall 42 forms retaining lips 136, 138 at the end of slots 118, 120. Lips 136, 138 which are dimensioned to come in contact with lateral projections 38a, 38b to prevent the complete ejection of capsule cartridge 30 during ear piercing.

Reference is now made to FIGS. 3 and 4 wherein plunger assembly 60 is shown in detail. Plunger assembly 60 includes a hollow shaft 61. A collar 62 is mounted at about a proximal end, relative to housing 70 in FIG. 3, of hollow shaft 61. A dog legged push rod 63 extends from the proximal end, relative to housing 70 in FIG. 3, of hollow shaft 61. Four ribs 64, 65, 73, and 77 (FIG. 6) extend along the length of hollow shaft 61 at spaced intervals and are substantially parallel with each other. A gap 66 is formed in each rib in an area near collar 62; gap 66 forming a circle about shaft 61 coaxial with collar 62. A tear shaped knob 68 is affixed to the distal end of hollow shaft 61 forming a blind hole 71 within shaft 61. A spring 67 is disposed within blind hole 71.

During assembly, spring 67 is placed within blind hole 71. Shaft 61 is rotatably mounted about shaft 54 of centerpiece 40. Spring 67 is retained at one end by shaft 54 and at another end by knob 68. A portion of plunger assembly 60 is maintained within housing 70 while the distal end of plunger assembly 60 extends without housing 70.

Push rod 63 is received within indentation 108 of indicator 106 so that indicator 106 rotates with the rotation of shaft 61. In an extended position (FIG. 4) the circle formed by gap 66 is disposed within opening 96. Accordingly, shaft 61 is able to rotate about shaft 54. Collar 62 and ribs 64 extend to a height which is greater than the outer perimeter of opening 96 at the rear of housing 70. Accordingly, collar 62 prevents plunger assembly 60 from falling out of housing 70. Additionally, ribs 64, 65, 73 and 77 are dimensioned to be received by slots 100a, 100b and 98 so that plunger assembly 60 may only be pushed into housing 70 when ribs 64, 65, 73 and 77 are aligned with respective slots 98, 100a, 100b. Push rod 63 is positioned coaxially with rib 65. Slots 100a, 100b are positioned so that when rib 65 is disposed within either one of slots 100a, 100b, push rod 63 is coaxial with a respective chamber 79, 80. Additionally, as push rod 63 is rotated, push rod 63 rotates marker 106 moving red mark 110 of indicator 106 to be viewed from the appropriate window 102a, 102b to indicate which earring 134 is to be ejected. Push rod 63 is formed with a wedge 59 to provide mass and stability behind push rod 63.

Reference is now made to FIGS. 5, 6 and 8–12 illustrating the operation of ear piercing assembly 20. Prior to operation, as discussed above in greater detail, an ear piercing earring 134 is placed within half wall 31a of capsule cartridge 30. Half wall 31a is then rotated about hinge 32. Capsule cartridge 30 is then placed between housing half 72a and centerpiece 40. Plunger assembly 60 is then assembled and disposed about shaft 54 and second capsule cartridge 30 is disposed between centerpiece 40 and housing half 72b. Clutches 75 are placed within a respective anvil 74a, 74b. The entire ear piercing assembly is packaged, and sterilized.

At the site of application, the sterilized ear piercing assembly 20 is removed from its enclosed package. To begin piercing, an earlobe 154 is disposed within saddle region 104. By way of example, to begin piercing, knob 68 is in the right position of arrow A as viewed in FIG. 5, so that push rod 63 is adjacent and coaxial with opening 87 of chamber 80 (FIG. 6). In this position, ribs 65 and 73 are aligned with slots 100a, 100b and ribs 64 and 77 are aligned with respective slots 98. Red mark 110 of indicator 106 is positioned below window 102a so that red mark 110 can be viewed through window 102a to indicate that push rod 63 is aligned with ear piercing earring 134 positioned within chamber 80. Additionally, the pointed end of knob 68 points in the direction of chamber 80 providing a supplemental indication of which ear piercing earring 134 will be ejected.

The hand of a user is positioned about ear piercing assembly 20 so that the user's finger is anchored within the cavity formed by tunnel 92a and the palm of the user is anchored about knob 68 so that a squeezing pressure is applied to plunger assembly 60 when the finger of the user is pulled towards the palm of the user. As a squeezing pressure is applied to plunger assembly 60, shaft 61 moves into housing 70 providing a force in the direction of arrow B (FIG. 4) causing push rod 63 to move in the direction of arrow B. Ribs 64, 77 and 65, 73 pass through and are guided by slots 98, 100a and 100b, respectively so that shaft 61 is prevented from rotating as it is pushed in the direction of arrow B maintaining push rod 63 oriented relative to opening 87 of chamber 80.

As plunger assembly 60 is squeezed, push rod 63 passes through opening 87 and contacts capsule cartridge 30 pushing capsule cartridge 30 in the direction of arrow B. As capsule cartridge 30 slides within chamber 80, capsule cartridge 30 extends from chamber 80 towards earlobe 154. Elongated channel 34 formed at the front travelling end of capsule cartridge 30 aids in aiming capsule cartridge 30 towards earlobe 154.

The leading end, in the direction of arrow B, of push rod 63 is dimensioned to provide a slight tension fit with opening 37 of capsule cartridge 30 and is formed with a waist 69 so that initially, push rod 63 does not enter capsule cartridge 30 but pushes capsule cartridge 30 along tracks 82*a*, 52. As plunger assembly 60 is continually squeezed, push rod 63 continues to slide cartridge 30 through chamber 80 until lateral projections 38*a*, 38*b* contact retaining lips 136, 138 stopping further sliding of capsule cartridge 30. As shaft 61 is continuously moved within housing 70, the force on push rod 63 causes push rod 63 to move through opening 37 formed by indentations 37*a*, 37*b*.

Figure 11:
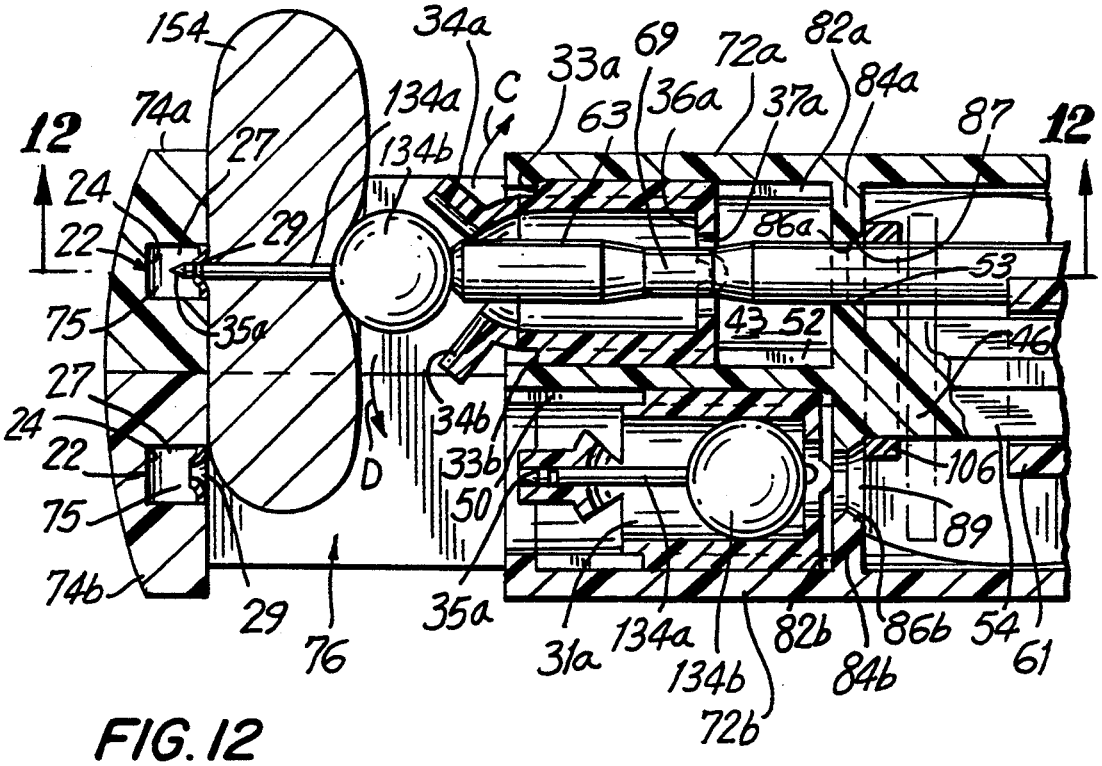
FIG. 11 is a fragmented sectional view of the ear piercing apparatus showing the ear piercing earring being ejected in accordance with the invention.
Figure 12:
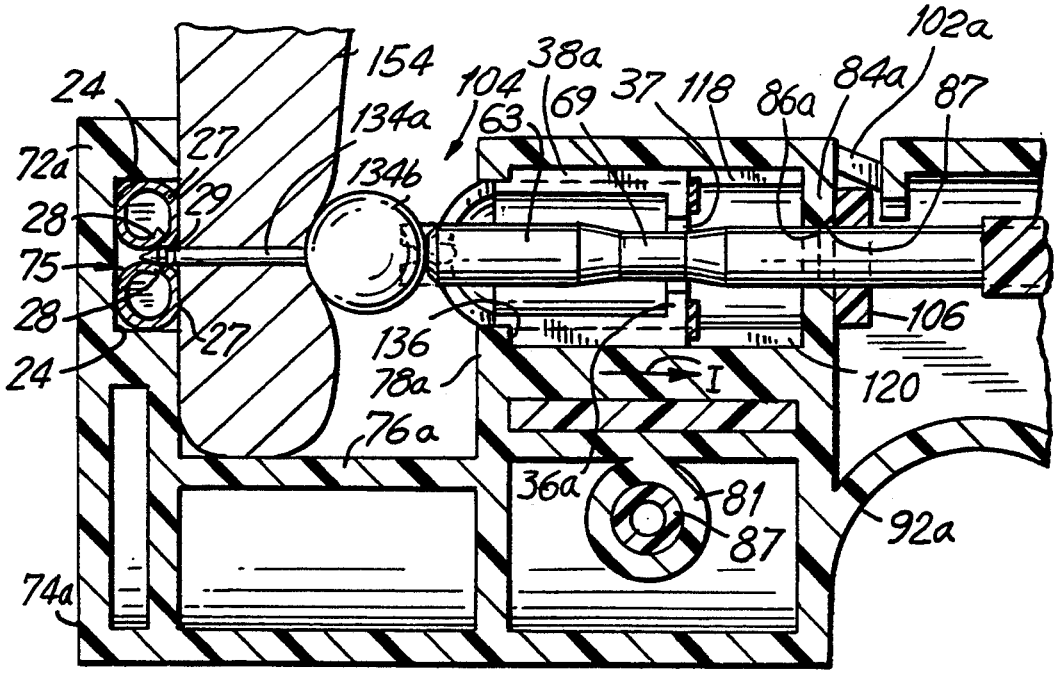
FIG. 12 is a sectional view taken along line 12—12 of FIG. 11.

Push rod 63 comes in contact with ear piercing earring head 134*b* pushing ear piercing earring head 134*b* through capsule cartridge 30, causing the tapered walls 31*a*, 31*b* to separate in the direction of arrows C and D (FIG. 11). Flexible reliefs 33*a*, 33*b* are closed as tapered walls 31*a*, 31*b* are opened by the earring 134, thereby providing clearance to allow separation of tapered walls 31*a*, 31*b* and exit of ear piercing earring head 134*b*. Piercing pin 134*a* pierces earlobe 154 and is secured by ends 28 of clutch 75 and contacts the rear of blind hole 24. During the driving of ear piercing earring 134, waist 69 passes through opening 37 so that there is no drag or interference on push rod 63 as ear piercing earring 134 is being driven through the earlobe 154 (FIGS. 11, 12). Blind hole 24 acts as a stop to piercing pin 134*a*, preventing further driving by push rod 63. Spring 67 may be dimensioned to absorb any continued driving force adjusting the drive length and drive force to prevent overdriving. By separating ends 28 of clutch 75, the tension between ends 28 and nib 26 is relieved allowing free removal of clutch 75 from anvil 74.

Plunger assembly 60 is then released. Spring 67 provides a biasing force pushing shaft 61 out from housing 70. Because shaft 61 is affixed to push rod 63, as shaft 61 moves in a direction opposite to that of arrow B, push rod 63 is withdrawn into housing 70. As push rod 63 is withdrawn, the wider distal end of push rod 63, beyond waist 69, engages opening 37 with a slight friction fit sliding capsule cartridge 30 in the direction of arrow I (FIG. 12), within chamber 80. Capsule cartridge 30 is closed as it retracts within chamber 80. Once rear walls 36*a*, 36*b* contact rear walls 84*a*, 46, capsule cartridge 30 is prevented from moving any further in the direction of arrow I. A ramp transition is provided between waist 69 and the tip of push rod 63 allowing push rod 63 to slide through opening 37. Push rod 63 returns to the position shown in FIGS. 4 and 6.

To form a second hole within an earlobe utilizing the second ear piercing earring 134 contained within housing 70, knob 68 is rotated in the direction of arrow D (FIG. 10) rotating shaft 61 so that push rod 63 is now coaxial with opening 89 behind chamber 79. During rotation, shaft 61 is disposed within housing 70 so that back wall 94 passes through gaps 66. Because indicator 106 rotates with push rod 63, red mark 110 is now positioned below window 102*b* to indicate that push rod 63 is in position to eject the ear piercing earring 134 contained within chamber 79. Respective ribs 64, 65, 73 and 77 are now again aligned with slots 98 and 100*a*, 100*b*. Additionally, because ribs 64, 65, 73 and 77 provide shaft 61 with a diameter greater than opening 96, shaft 61 cannot be inadvertently pressed into housing 70 during rotation preventing misfiring or damage to push rod 63. The process described above is now repeated to eject the second ear piercing earring 134 contained within chamber 79.

When both piercing earrings 134 have been ejected, the spent ear piercing assembly 20 is discarded preventing cross contamination to the next person to have their ears pierced.

By constructing an ear piercing assembly having a push rod that is pivotable about the center of the device, so that the push rod is displaceable from a first position behind a first earring coaxial with an earring retaining chamber to a second position coaxial with a second earring retaining chamber without touching the earrings, an ear piercing assembly which effectively eliminates handling of the earrings after sterilization utilizing a simplified construction as provided. Additionally, utilizing a capsule cartridge in which the hinge is formed at the rear of the capsule cartridge, it becomes possible to utilize a variety of ornamental earrings in the ear piercing process.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ear piercing assembly comprising housing means, a first and second ear piercing earring releasably supported within said housing means; plunger assembly means disposed within said housing means for selectively ejecting an ear piercing earring from said housing means, said plunger assembly means being movable between a first position for ejecting said first ear piercing earring from said housing means and a second position for ejecting said second ear piercing earring from said housing means.

2. The ear piercing assembly of claim 1, wherein said plunger assembly means includes a shaft rotatably mounted within said housing means and a dog legged push rod extending from said shaft, said shaft being rotatable to position said push rod in either one of said first and second positions.

3. The ear piercing assembly of claim 1, further comprising orientation means for selectively maintaining said plunger assembly means oriented in either one of said first position or second position.

4. The ear piercing assembly of claim 3, wherein said plunger assembly means includes a shaft rotatably mounted within said housing means and a dog legged push rod extending from said shaft, said shaft being rotatable to position said push rod in either one of said first and second position and said orientation means including a plurality of slots formed on said housing means and ribs extending along said shaft and being dimensioned to be received by said slots, said slots cooperating with said ribs to prevent rotation of said shaft when said plunger assembly means is in either one of said first position or second position.

5. The ear piercing assembly of claim 1, further comprising indicator means for indicating when said plunger assembly means is in said first position and indicating when said plunger assembly means is in said second position.

6. The ear piercing assembly of claim 5, wherein said plunger assembly means includes a shaft rotatably mounted within said housing means and a dog legged push rod extending from said shaft, said shaft being rotatable to position said push rod in either one of said first and second position, and said indicator means having a color mark on a portion thereof, said indicator means being mounted on said dog legged push rod to rotate therewith and said housing means being formed with at least a first window, said indicator means being movable to position said colored mark to be viewed through said first window.

7. The ear piercing assembly of claim 6, wherein said plunger assembly means includes a shaft rotatably mounted within a housing and a dog legged push rod extending from said shaft, said shaft being rotatable to position said push rod in either one of said first and second position, wherein said indicator means includes a tear-shaped knob mounted on said shaft.

8. The ear piercing assembly of claim 1, wherein said housing means includes a first half, a second half and a centerpiece, said centerpiece cooperating with first half and said second half to form a first chamber and a second chamber, said first ear piercing earring being disposed within said first chamber and said second ear piercing earring being disposed within said second chamber.

9. The ear piercing assembly of claim 8, wherein said plunger assembly means is rotatably mounted on said centerpiece.

10. The ear piercing assembly of claim 8, further comprising capsule cartridge means for maintaining an ear piercing earring therein, said capsule cartridge means being slidably disposed within said first chamber to allow movement between a first position and a second position within said first chamber.

11. The ear piercing assembly of claim 10, further comprising capsule cartridge orientation means for orienting said capsule relative to said first chamber.

12. The ear piercing assembly of claim 11, wherein said capsule cartridge orientation means includes a plurality of slots formed in said first chamber extending along the length of said first chamber in the direction of travel of said capsule cartridge means and at least one flange extending from said capsule cartridge means and adapted to be received in at least one of said plurality of slots.

13. The ear piercing assembly of claim 10, wherein said plunger assembly means further comprises retraction means for returning said capsule cartridge means from said second position to said first position.

14. The ear piercing assembly of claim 13, wherein said capsule cartridge means includes a first half wall and a second half wall, a hinge joining said first half wall to said second half wall at a rear portion thereof; an opening formed in a rear surface of said capsule cartridge means and said retraction means including said push rod, said push rod forming a friction fit with said capsule cartridge means at said opening.

15. The ear piercing assembly of claim 1, further comprising a first and second clutch releasably supported within said housing means.

16. An ear piercing assembly comprising housing means, a first and second ear piercing earring releasably supported within said housing means; plunger assembly means disposed within said housing means for selectively ejecting an ear piercing earring from said housing means, said plunger assembly means being movable between a first position for ejecting said first ear piercing earring from said housing means and a second position for ejecting said second ear piercing earring from said housing means;

orientation means for selectively maintaining said plunger assembly means oriented in either one of said first position or second position;

said plunger assembly means including a shaft rotatably mounted within said housing means and a dog legged push rod extending from said shaft, said shaft being rotatable to position said push rod in either one of said first and second position and said orientation means including a plurality of slots formed on said housing means and ribs extending along said shaft and being dimensioned to be received by said slots, said slots cooperating with said ribs to prevent rotation of said shaft when said plunger assembly means is in either one of said first position or second position; and indicator means for indicating when said plunger assembly means is in said first position and indicating when said plunger assembly means is in said second position.

* * * * *